United States Patent [19]

Avidan et al.

[11] Patent Number: 5,055,029

[45] Date of Patent: Oct. 8, 1991

[54] REDUCING $NO_x$ EMISSIONS FROM A CIRCULATING FLUID BED COMBUSTOR

[75] Inventors: Amos A. Avidan, Yardley, Pa.; Arthur A. Chin, Cherry Hill, N.J.; Gary J. Green, Yardley, Pa.

[73] Assignee: Mobil Oil Corporation, Fairfax, Va.

[21] Appl. No.: 660,913

[22] Filed: Feb. 27, 1991

Related U.S. Application Data

[63] Continuation of Ser. No. 468,294, Jan. 22, 1990, abandoned.

[51] Int. Cl.[5] ..... F23D 3/40

[52] U.S. Cl. ..... 431/7; 110/342

[58] Field of Search ..... 110/345, 344, 342; 431/7

[56] References Cited

U.S. PATENT DOCUMENTS

| | | | |
|---|---|---|---|
| 4,235,704 | 11/1980 | Luckenbach | 208/113 |
| 4,735,705 | 4/1988 | Burk et al. | 110/345 |
| 4,836,117 | 6/1989 | Teller et al. | 110/342 |
| 4,915,037 | 4/1990 | Avidan | 110/342 |
| 4,926,766 | 5/1990 | Avidan . | |
| 4,927,348 | 5/1990 | Avidan | 431/7 |

*Primary Examiner*—Carroll B. Dority

*Attorney, Agent, or Firm*—A. J. McKillop; C. J. Speciale; Richard D. Stone

[57] ABSTRACT

A circulating fluid bed combustion (CFBC) unit, which burns a carbon and nitrogen containing fuel to produce heat and flue gas comprising $NO_x$, operates with reduced emissions of $NO_x$ from the flue gas by adding to the circulating fluid bed a catalytically effective amount of a $DeNO_x$ catalyst, such as bismuth oxide on a silica/alumina support. The $DeNO_x$ catalyst may circulate freely with the circulating inventory of particulates in the CFB, or can be disposed on a heavier particle which "slips" and has an extended residence time in the combustion zone where the carbonaceous fuel is burned. A CO combustion promoter, such as Pt on silica/alumina may also be present.

21 Claims, 1 Drawing Sheet

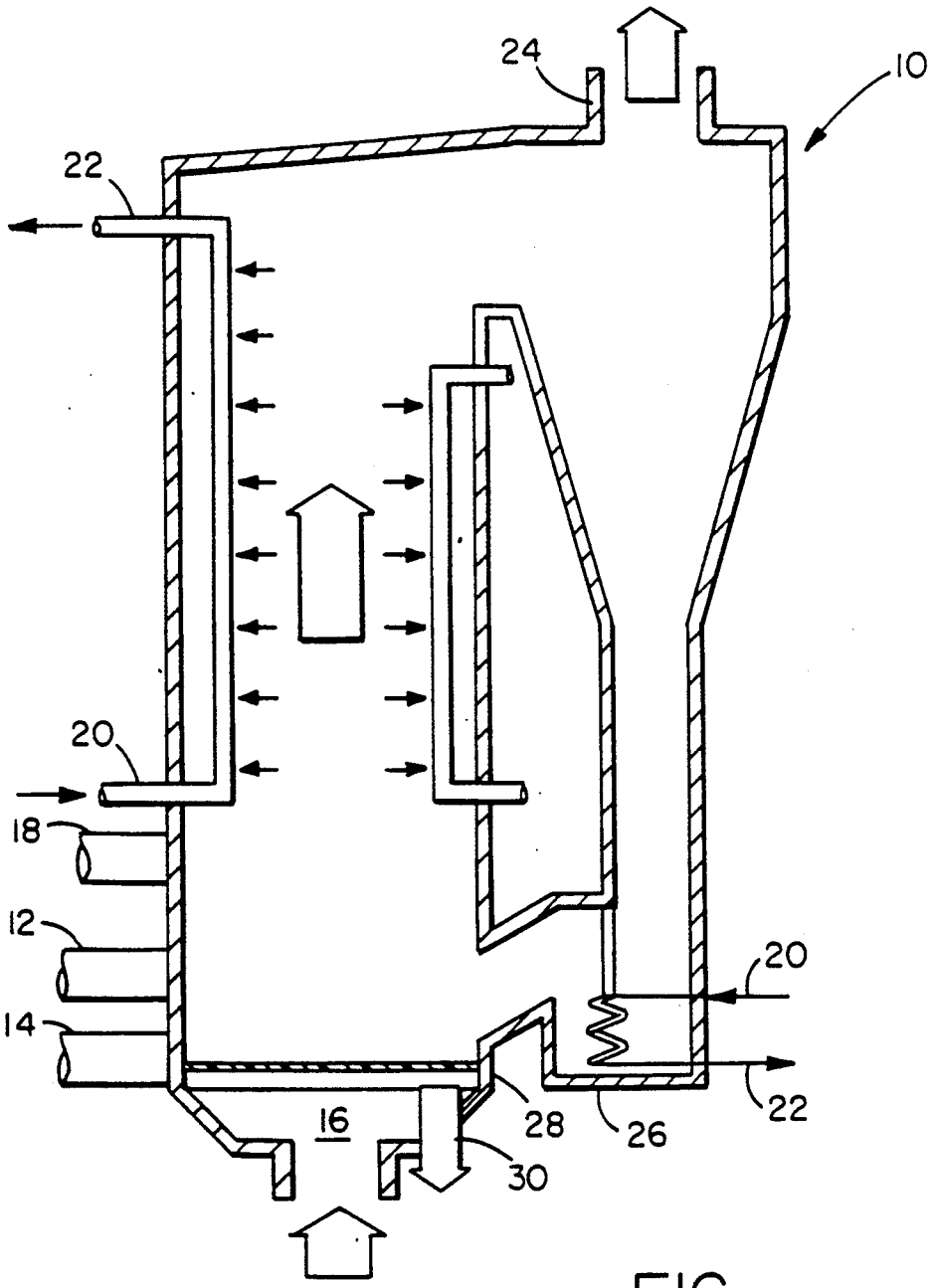
FIG.
(PRIOR ART)

REDUCING $NO_x$ EMISSIONS FROM A CIRCULATING FLUID BED COMBUSTOR

This is a continuation of copending application Ser. No. 468,294, filed on Jan. 22, 1990 and now abandoned.

BACKGROUND OF THE INVENTION

Field of the Invention

This invention is concerned with circulating fluid bed combustion units, and a way to operate them with reduced $NO_x$ emissions.

Description of the Prior Art

BACKGROUND

Fluidized bed combustion is a mature technology. Many fluidized bed processes where combustion occurs are known, including the regenerators associated with fluidized catalytic cracking (FCC) units, fluidized coal combustors, and "regenerators" associated with fluid cokers.

A recent development in fluidized bed combustion has been the commercialization of circulating fluid bed (CFB) boilers.

In CFB units, operation is complex. A fuel, usually a low grade fuel with large concentrations of sulfur and other contaminants, e.g. coal, is burned in a riser combustor. The flow regime is primarily that of a fast fluidized bed, i.e., there are no large "bubbles". Motive force for the fast fluidized bed is usually combustion air added at the base of the riser. There is usually an extremely large range of particle sizes in CFB units.

Combustion air is generally added to the base of the fast fluidized bed, and the resulting flue gas is discharged from the top of the fast fluidized bed, generally into a cyclone separator which recovers most of the larger particles, typically 100 microns plus, while allowing finer materials (fly ash) to be discharged with the flue gas. Solids recovered by the cyclone are recycled into the fast fluidized bed.

Heat is removed from the CFB units in many places. CFB units take advantage of high heat transfer rates which are obtainable in fluidized beds, and provide for one or more areas of heat recovery from the fluidized bed. Most units have at least one relatively dense phase fluidized bed heat exchanger intermediate the cyclone separator solids discharge and the fast fluidized bed combustor.

Fluid flow in CFBs is complex because of the tremendous range in particle size of materials which must be handled by many CFBs. When coal is the feed to a CFB unit, the particle size distribution can range from submicron particles to particles of several inches in diameter. The solids inventory includes fly ash, ground dolomite or limestone, and perhaps a few particles of ground coal.

Particles less than 100 microns in diameter usually have a short life in CFB units, because the low efficiency cyclones usually associated with such units must be able to let the fly ash out, while retaining essentially all of the 100 + micron material. The fines include conventional fly ash and attrited gypsum, which is the reaction product of the sulfur in the fuel with a source of calcium, typically the calcium is from dolomite or limestone. The 100 + micron material usually represents coal, or ground sulfur absorbing material such as dolomite.

The 100 micron-500 micron material in a CFB represents much of the circulating particulate inventory. Usually this material is the dolomite, limestone, and similar materials used as an $SO_x$ acceptor, and some portion of the low grade fuels such as coal. When clean, or at least low sulfur, fuels such as wood chips are burned the sulfur acceptor is not needed and some inert material such as sand is provided for fluidization.

The coal particles may range in size from several inches when first added to the fast fluidized bed to theoretically submicron particles produced by explosion or disintegration of large size particles of coal. The majority of the coal is in large particles, typically 300–1000 microns, which tend to remain in a lower portion of the CFB, by elutriation.

Many CFB units are designed to handle small amounts of agglomerated ash. At the temperatures at which CFBs operate (usually 1550°-1650° F.) there is some sintering of ash, which forms larger and larger particles. Many CFBs are designed to allow large ash agglomerates, typically in the order of 1000–2000 microns, to drop out of the bottom of the CFB unit or to be removed intermittently.

The chemical reactions occurring during CFB operation are complex. Coke combustion, reactions of sulfur and nitrogen compounds with adsorbents, reactions of $NO_x$ with reducing gases (such as CO which may be present), etc., are representative reactions.

Typical circulating fluidized bed designs are disclosed in U.S. Pat. No. 4,776,288 and U.S. Pat. No. 4,688,521, which are incorporated by reference.

Circulating fluid bed combustion systems operating with staged air injection, or staged firing, as disclosed in U.S. Pat. No. 4,462,341 or in a reducing mode circulating fluid bed combustion unit, such as disclosed in U.S. Pat. No. 4,579,070 will minimize somewhat $NO_x$ emissions. The contents of both of these patents are incorporated herein by reference.

Separation means used to remove recirculating solids from flue gas may comprise cyclones, or the gas and particle separation means disclosed in U.S. Pat. No. 4,442,797 which is incorporated herein by reference.

We reviewed the state of the art in circulating fluidized bed technology. Fortunately most of the work on circulating fluidized beds has been published in two volumes. The first was Circulating Fluidized Bed Technology, Proceedings of the First International Conference on Circulating Fluidized Beds, Halifax, Nova Scotia, Canada, Nov. 18–20, 1985, edited by Prabir Basu, Pergamon Press (hereafter CFB I) and, more recently, by Circulating Fluidized Bed Technology II, Proceedings of the Second International Conference on Circulating Fluidized Beds, Compiegne, France, 14–18 March 1988, edited by Prabir Basu and Jean Francois Large, Pergamon Press (hereafter CFB II).

Other workers were aware of the problems remaining in use of CFB units, see e.g. Analysis of Circulating Fluidized Bed Combustion Technology and Scope For Future Development, Takehiko Furusawa and Tadaaki Shimizu, page 51, in CFB II. The authors focused on three areas:

1. Heat Recovery
2. Cyclones and Carbon Burn-up
3. $NO_x$ emissions.

One of CFBC's main advantages over pulverized coal burning is lower $NO_x$ emissions, because of lower operating temperature. Despite the lower $NO_x$ emissions, further improvements are needed in CFBC systems in regard to lowering $NO_x$ emissions further. The problems CFB units have in regards to $NO_x$ emissions will first be reviewed.

Because of their high temperature operation, and customary operation with excess air, CFB units generally emit relatively low levels of CO in the flue gas. Such a mode of operation tends to increase $NO_x$ emissions. The high temperatures and excess air are needed to completely afterburn CO to $CO_2$, and also to completely oxidize any sulfur compounds that may be present to $SO_x$, $SO_x$ efficiently reacts with limestone or dolomite in the CFB unit, whereas non oxidized sulfur compounds do not.

$NO_x$ emissions can be reduced somewhat by staged firing, or multiple levels of injection of combustion air in the CFB unit. These approaches help some, but also reduce somewhat the fuel burning capacity of the CFB unit and/or require additional capital and/or operating expense. $NO_x$ levels as low as 50 ppm can be achieved, even when relatively high nitrogen containing fuels are burned.

It has recently been proposed to reduce the amount of excess air needed to operate a CFBC system, while maintaining or even reducing the level of CO emissions. In U.S. Pat. No. 4,927,348, Avidan, (U.S. Ser. No. 270,929, filed on Nov. 14, 1988) one of the present inventors suggested adding a CO combustion promoter, such as Pt on alumina, and reducing the amount of air added, so that less than 10% excess air was present. Such an approach will greatly improve the efficiency of CFBC systems, in regard to excess air, and will also permit reduction in the levels of CO emissions. The presence of relatively large amounts of the powerful CO combustion promoter proposed for use therein can also lead to increased emissions of $NO_x$, especially if Pt is added to a CFB unit, and relatively large amounts of excess air are added. With the addition of a combustion promoter, such as Pt, it should also be possible to operate the CFBC unit at a lower temperature, and this will lower $NO_x$ emissions. The Pt CO combustion promoter will allow greater flexibility in operating CFBC units, and will permit these units to operate at conditions which could either increase or decrease $NO_x$ emissions.

Thus although CFBC systems are very good at burning dirty fuels in a clean manner, and indeed are the best available technology, it would be beneficial if the already favorable emissions characteristics of these units could be improved, particularly with respect to $NO_x$ emissions. This would allow even more widespread use of CFBC systems to burn heavy fuel, and would allow existing CFBC systems to burn fuels which were even more nitrogenous than those currently used, e.g., refinery wastes, or nitrogenous fuels such as the low grade coke produced by some refineries. It would also be beneficial if existing CFB units, those operating without elaborate staged combustion schemes to reduce $NO_x$, could be modified to reduce $NO_x$ emissions, or to burn more nitrogenous fuels.

A way has now been discovered to reduce $NO_x$ emissions from all CFBC systems. Rather than resort to expensive modifications of the CFBC system, or to expensive flue gas treatments of CFBC flue gas, we devised a way to reduce the $NO_x$ catalytically, as it is formed, or perhaps shortly after formation of $NO_x$, in the CFBC system.

SUMMARY OF THE INVENTION

Accordingly, the present invention provides in a circulating fluidized bed combustion zone wherein a carbon and nitrogen-containing fuel is burned at an elevated temperature by contact with oxygen-containing gas in a generally vertical combustor comprising a fast fluidized bed of particulates wherein at least a majority of the particulate matter in the fast fluidized bed has a particle diameter in excess of 100 microns, to generate a flue gas/particulate stream which is discharged from the top of the combustor, said flue gas comprising excess oxygen, nitrogen oxides ($NO_x$), fines having a particle diameter less than about 100 microns, and circulating particles having an average particle size of about 100–500 microns, which flue gas passes through a separation means to recover from the flue gas at least a majority of the 100–500 micron particles which are recycled to the circulating fluidized bed combustion zone, the improvement comprising burning said fuel in the presence of a catalytically effective amount of a $DeNO_x$ catalyst which reduces the amount of $NO_x$ present in the flue gas relative to operation without addition of a $DeNO_x$ catalyst.

In another embodiment, the present invention provides in a circulating fluidized bed combustion zone wherein a carbon and nitrogen-containing fuel is burned at an elevated temperature by contact with oxygen-containing gas in a generally vertical combustor comprising a fast fluidized bed of particulates wherein at least majority of the particulate matter in the fast fluidized bed has a particle diameter in excess of 100 microns, to generate a flue gas/particulate stream which is discharged from the top of the combustor, said flue gas comprising excess oxygen, nitrogen oxides ($NO_x$), fines having a particle diameter less than about 100 microns, and circulating particles having an average particle size of about 100–500 microns, which flue gas passes through a separation means to recover from the flue gas at least a majority of the 100–500 micron particles which are recycled to the circulating fluidized bed combustion zone, the improvement comprising burning said fuel in the presence of 0.01 to 10 wt % of $DeNO_x$ catalyst which reduces the amount of $NO_x$ present in the flue gas by at least 25% relative to operation without addition of a $DeNO_x$ catalyst.

BRIEF DESCRIPTION OF THE DRAWING

The Figure is a simplified schematic representation of a typical circulating fluid-bed (CFB) combustor of the prior art.

DETAILED DESCRIPTION OF THE INVENTION

The process of the present invention can be better understood by considering first the way a conventional CFBC system, such as that shown in the Figure, operates.

A typical circulating fluid-bed combustor is illustrated in the Figure, wherein the combustor 10 is fed with a source of inert particles such as crushed limestone, through conduit 12 and fuel through conduit 14 together with a source of primary air through conduit 16 which ordinarily provides about 40–80% of the air required for combustion. A source of secondary air is fed through conduit 18 which provides the remaining 20–60% of the air necessary for combustion. Water circulating through heat exchangers 20, 20' is turned into steam when exiting conduits 22, 22'' of heat exchangers 20, 20'. Gaseous products of combustion (flue gas) are removed through outlet 24 of combustor 10 with a recycle of the limestone and incompletely burned fuel occurring in conduit 26. Ash may be removed through grate 28 and through conduit 30 to a site remote from combustor 10. The fuel fed through conduit 14 may include hazardous wastes and sludges which are otherwise expensive to dispose of. The combustor can also burn low-value petroleum coke, or other refinery products. For example, in refineries limited by fuel gas production, excess fuel gas, such as FCC fuel gas, can be burned in the CFB combustor in combination with other fuels.

A more detailed discussion of some of the important operating variables of CFBC systems follows,

CIRCULATING FLUID BED COMBUSTION SYSTEMS

Any commercially available circulating fluidized bed combustion unit can be improved by the process of the present invention. Several equipment vendors supply these systems. All share the same essential elements, primarily a fast fluidized bed where combustion occurs, and with cyclones and associated equipment necessary to continuously recover and recycle essentially all of the 100 micron plus material discharged from the fast fluidized bed and recycle it to the base of the fast fluidized bed. The fines and ash, typically the particles of 0.01 to 40 microns, are usually rejected by the system, and much if not most of the 40 to 100 micron particles are rejected by the cyclones and thus removed from the circulating particulate inventory.

Heat exchangers, or equivalent heat removal means, are an essential part of CFBC units, and these can be provided at may places in the CFBC system. Most CFBC systems remove significant amounts of heat both from the combustion chamber and from the flue gas. A typical unit, such as a Pyroflow (a registered trademark of the Pyropower Corporation, a member of the Ahlstrom Group) unit, removes about.45% of the heat from the combustion chamber and the remainder in convection sections. Immersion of heat exchanger tubes, indeed of any heat exchanger surface at all, within fluidized beds is minimized in such units to improve mechanical reliability.

FUEL

Any conventional fuel heretofore burned in CFBC units can be used. The following fuels have already been burned in CFBC units —coal, coal rejects and washings,wood, bark, petroleum coke, anthracite culm, tires, sewage sludge, oil shale, peat, printing ink, lignite, diatomite, bitumen and asphaltenes, waste oils, agricultural waste and others. The process of the present invention will permit many of these difficult fuels, especially high nitrogen fuels such as oil shale and petroleum coke, to be burned in existing CFBC units which could not tolerate such fuels, or it will improve the operation of those unit currently burning such difficult fuels.

$DeNO_x$CATALYST

The process of the present invention can use any $DeNO_x$ catalyst which, when present in the atmosphere typical of a CFBC system, will promote the reduction of $NO_x$ to nitrogen.

Suitable catalysts include those which have been used for $NO_x$ abatement in other uses, such as in FCC units, or in flue gas cleanup processes downstream of combustion processes. Catalysts which can be used include 1. Metals-containing or metal exchanged zeolites. Any metal exhibiting $DeNO_x$ activity, preferably a transition metal such as Ge, Fe, Ni, Co, Cr,Cu, Bi, Pb, Sb, Zn, Sn, or Mn can be used in any suitable zeolite, such as zeolite beta, zeolite Y, ZSM-35, ZSM-23, MCM-22, zeolite L, VPI-5, pillared clays, and similar materials. Cu-ZSM-5 is a preferred catalyst of this type. Bi-Y or Bi-ZSM-5 is another preferred catalyst of this type.
2. zeolites modified with rare earths such as Ce and Y group elements.
3. perovskites, such as ARuO3 and AMnO3, where A is La, Sr, Ba, Na, K, Rb or Pb and mixtures thereof as described in *The Catalytic Chemistry of Nitrogen Oxides,* R. L. Klimsch and J. G. Larson, Ed. Plenum Press, N.Y. 1974, p. 215;
4. spinels, such as CuCo204, as described in *Applied Catalysis,* 34 (1987) 65–76.
5. Metals, or metal compounds, exhibiting $DeNO_x$ activity, used neat or deposited on a non zeolitic support, e.g, bismuth oxide on silica/alumina is preferred. $V_2O_5$ on titania, or $V_2O_5$ on titania with a modifier such as $W_2O_3$ (tungsten oxide), commonly used as a flue gas cleanup catalyst, material may also be used herein. The metals or metal compounds may also be added with the fuel, or sprayed in to the CFBC unit as a solution or dispersion. The non zeolitic support may be limestone or dolomite, which are added anyway to remove SOx.

The zeolite catalysts, and the bismuth catalyst, are most often supported on conventional porous supports, such as alumina, silica-alumina, $TiO_2$, $ZrO_2$, and similar materials.

The particle size of the $DeNO_x$ additive catalyst can vary greatly, depending on whether or not once through use can be tolerated and on where the $DeNO_x$ catalyst will be most effective.

It is beneficial if the particles have physical properties which will allow them to be retained easily by the low efficiency cyclones associated with the CFB units. In most units this will mean that the terminal velocity of the promoter particles should be less than 15 feet per second, and preferably is about 4–12 feet per second.

If an inexpensive and effective $DeNO_x$ catalyst is found, it may be used in sufficient amounts, and in such a form, e.g., particles less than 100 microns in diameter, such that much of the $DeNO_x$ catalyst is used only a single time. This represents an extreme condition, which will usually not be preferred. When once through, or almost once through, use of $DeNO_x$ catalyst is contemplated, then the use of a stable, long lasting support becomes less important.

Use of a $DeNO_x$ catalyst on a particle having a size which permits the particle to freely circulate, e.g., a particle size of 100–500 microns, will be preferred in most operations, because such a material can easily circulate with the particulate inventory in a CFBC unit, will readily be retained by existing cyclones in the unit, and will accumulate to some limited extent above the base of the combustion zone. Our preferred $DeNO_x$ catalyst will elutriate or slip to some extent in the combustion zone, so that it will collect where the $NO_x$ concentration is high. This multiplies the effectiveness of the $DeNO_x$ catalyst, and also keeps it out of the base of the combustion zone, where somewhat reducing conditions make the presence of $DeNO_x$ catalyst of lesser importance.

Use of a $DeNO_x$ catalyst on a particle having a size which causes the the particle to settle to a significant extent, e.g., a particle size of 500 to 1000 microns can, depending on superficial vapor velocities in the combustion zone, slips so much that it can remain practically suspended in the combustion zone. These materials will be completely retained by existing cyclones in the unit, and will accumulate to a great extent near and just above the base of the combustion zone. This multiplies the effectiveness of the $DeNO_x$ catalyst, but keeps it in a region where not much $NO_x$ is created.

The optimum particle size for the DeNOx catalyst is believed to be about 100 to 1000 microns, and most preferably about 400 to 600 microns.

Preferably, the $DeNO_x$ catalyst is disposed on a highly porous support. The support preferably has a porosity exceeding 50 percent. The particle density should be within the range of 1.4–2.4 g/cc, and preferably within the range of 1.5–2 g/cc. Many highly porous silica/aluminas and aluminas have particle densities of about 2 g/cc, and are ideal for use herein.

CO COMBUSTION PROMOTERS

Although the process of the present invention does not require the use of a CO combustion promoter, it permits CO combustion promoters to be used effectively, and ameliorates the potential increase in $NO_x$ emissions that might be expected from more oxidizing conditions in the CFBC. Any kind of CO combustion promoter can be used, added in any manner. We prefer to use either a circulating CO combustion promoter or a fast settling CO combustion promoter or combination of both. Each of the preferred types of CO combustion promoter will be discussed.

CIRCULATING CO COMBUSTION PROMOTER

A circulating CO combustion promoter is one which will readily circulate throughout the system, but will not be blown out with the fines. The promoter material should have an average particle size within the range of 80–400 microns, and preferably 100–300 microns, and most preferably 125–250 microns. More details on the preferred circulating CO combustion promoter are provided in U.S. Pat. No. 4,926,766, (U.S. Ser. No 270,930, filed on Nov. 14, 1988), which is incorporated herein by reference. A brief discussion of circulating CO combustion promoters follows.

As previously discussed for the $DeNO_x$ catalyst, it is important for the CO combustion promoter particles to have physical properties which will allow them to be retained easily by the low efficiency cyclones associated with the CFB units. In most units this will mean that the terminal velocity of the promoter particles should be less than 15 feet per second, and preferably is about 4–12 feet per second.

Preferably, the CO combustion promoter is on a highly porous support. The support preferably has a porosity exceeding 50 percent. The particle density should be within the range of 1.4–2.4 g/cc, and preferably within the range of 1.5–2 g/cc. Many highly porous aluminas have particle densities of about 2 g/cc, and are ideal for use herein.

A majority, and preferably in excess of 90% of the CO combustion promoter is not on the outer surface of the promoter support. Conventional exchange/impregnation techniques will distribute the CO combustion promoter throughout the support particle.

The CO combustion promoter is preferably dispersed on a material having relatively high surface area, e.g. a surface area in excess of 20, and preferably above 50, or even in excess of 500 meters sq./g, and preferably having a surface area of 75–250 m sq./g.

Alumina is an ideal support for the CO combustion promoter, because of its porosity, density, and high surface area. All of these physical properties are essential to keep the platinum in a highly dispersed state, where it can promote rapid afterburning of carbon monoxide to carbon dioxide. Silica/alumina, or silica, kaolin or other similar catalyst supports can be used.

Operation with an amount of CO combustion promoter equivalent in activity to 0.001–100 ppm platinum, based on the total weight of solids circulating in the CFB, is preferred. Because of the high temperatures at which CFB units operate, it will be possible in many instances to operate with significantly less platinum, e.g., 0.01–10 wt. ppm platinum (or an equivalent amount of other CO combustion promoting metal, i.e., 3–5 wt. ppm Os is roughly equivalent to 1 wt. ppm Pt) may be used herein. In many units operation with 0.1–5 ppm platinum equivalents will give very good results.

Operation with much greater amounts of CO combustion promoter is possible, e.g., equivalent to 100–500 ppm Pt, but is usually not necessary, adds to the cost of the process, and probably will increase the $NO_x$ emissions, so such operation is not preferred. However, in units which for some reason must operate with high levels of CO combustion promoter, the process of the present invention will still significantly reduce $NO_x$ emissions. In this way some or all of the increase in $NO_x$ emissions caused by operation with excess amounts of Pt can be ameliorated by adding the $DeNO_x$ catalyst of the present invention.

Any CO combustion metals or compounds now used in fluidized catalytic cracking (FCC) units, i.e. the Group VIII noble metals, may be used herein. Pt, Pd, Ir, Rh, and Os may be used alone or in combinations. Some combinations, such as Pt/Rh, seem to reduce somewhat $NO_x$ emissions and may be preferred for use herein. The CO combustion promoter is preferably added as a metal or metal oxide deposited on a porous support. The promoter catalyst may be formed in situ by spraying a liquid containing the promoter into an appropriate part of the CFBC unit, or ex situ by removing a slip of particles having an appropriate size from the CFBC unit, impregnating them, and returning the impregnated particles to the unit. Different sizes of promoter support may be used to permit the CO combustion promoter to circulate freely, but be retained by the CFBC unit, or to settle and have a greatly increased residence time in the CFBC combustion zone.

FAST SETTLING PROMOTER SUPPORT

In many CFBC units it will be beneficial to use a fast settling CO combustion promoter, such as that described in U.S. Pat. No. 4,915,037, (U.S. Ser. No 270,931, filed Nov. 14, 1988, which is incorporated herein by reference. These "high slip" CO combustion promoters will be briefly reviewed below.

The CO combustion promoter may be on a catalyst support particle having a settling velocity well in excess of the 100–400 micron particles which comprise the bulk of the circulating material in a CFB unit. Ideally, the fast settling CO combustion promoters will not circulate in the circulating fluid bed, but instead will "slip" so rapidly in the CFB combustor that they have an extremely long residence time relative to the 100–300 micron circulating material or even remain relatively stationary within the CFB bed. Much segregation in CFB combustors now occurs, i.e., at the lower region of the CFB unit are large particles of coal, wood chips, etc., large particles of lime, dolomite, etc. segregate. These large pieces remain in the lower portion of the bed due to their large size, weight and terminal velocity. These large particles may, to some extent, act as a fragmented support for the fast settling promoter.

Use of 500 micron size particles of Pt on alumina as CO combustion promoter is preferred. Such particles will settle or slip to a great extent in the CFB combustion zone, but if swept out will readily circulate back to the CFB combustion zone. Depending on the pressure, inventory of particulates, and design of the combustion zone, e.g., the superficial vapor velocity, such 500 micron particles could settle and float in the combustion zone, or could circulate. They certainly will segregate to some extent and have an extended residence time in the combustion zone relative to the circulating limestone, dolomite, etc. This has many advantages. The CO combustion promoter, at the 1300°–1700° F. temperatures contemplated for use herein, is an extremely efficient oxidation catalyst. Operation with as little as 0.001–100 ppm Pt equivalent CO combustion promoter metal will profoundly decrease CO emissions.

Because of the high settling velocity of the CO combustion promoter, very little of it will circulate through the CFB unit, and essentially none of it will be lost in the cyclones. Because the promoter tends to remain stationary, or for an extended period of time if not stationary, in the middle and upper regions of the CFB combustor zone, it will spend very little time in the lower regions where extremely high temperatures can be experienced due to localized burning. The "suspended" combustion promoter will be protected to some extent from fly ash deposition.

Another benefit to use of fast settling promoter is that the Pt, etc., is segregated where it is most needed, namely in the CO and $O_2$ rich regions just above the coke or coal burning zone in the combustor. CO combustion promoter does nothing useful in e.g., the cyclone dipleg.

It is believed that much of the ash agglomeration occurs during passage through the base of the combustor zone, so the life of the fast settling CO combustion promoter will be significantly extended due to its relatively permanent suspension above this combustion zone.

Regardless of the size of the CO combustion promoter, it is beneficial if the amount and type of promoter do not increase $NO_x$ emissions. Some bimetallic CO combustion promoters, such as Pt-Rh, are effective at promoting CO oxidation, but do not increase $NO_x$ emissions as much as an equivalent amount of Pt. This effect is discussed in U.S. Pat. No. 4,290,878 and U.S. Pat. No. 4,300,997. Steaming of the CO combustion promoter may also be beneficial, in regards to minimizing $NO_x$ emissions, as discussed in U.S. Pat. No. 4,199,435.

CHANGES IN CFB OPERATING CONDITIONS

The process of the present invention does not require any changes in the operation of the CFBC unit, although it allows significant changes to be made.

If the optional CO combustion promoter is used along with the $DeNO_x$ additive, the operation of the CFBC can be changed significantly to either reduce or to increase $NO_x$ emissions.

With CO combustion promoter, there can be profound reductions in the amount of excess air supplied, and significant reductions in the operating temperature of the unit, and reductions in CO and/or $NO_x$ emissions. In such a low $NO_x$ mode, the $DeNO_x$ catalyst of the present invention will reduce $NO_x$ emissions even further.

If the CFBC unit is ru with optional CO combustion promoter, and fired as hard as possible, i.e., with excess air and at high temperatures, then $NO_x$ emissions from the CFBC flue gas will increase. The addition of the $DeNO_x$ catalyst of the invention will moderate the increase in $NO_x$ emissions associated with such an operating regime.

The optimum $DeNO_x$ catalyst may be different for such different firing modes. The thermal and hydrothermal stability of the $DeNO_x$ catalyst must be considered. For relatively low temperature operation, and/or for operation with relatively low steam partial pressures in the CFBC combustor, zeolitic catalysts may be preferred. For high temperature operation, and/or for operation in steaming or harsh chemical environments, it may be preferred to use a $DeNO_x$ catalyst on an amorphous support. The preferred catalyst, Bi on silica/alumina, will reduce $NO_x$ emissions catalytically at most of the conditions at which CFBC systems now operate, namely excess air and temperatures around 1500 F.

TEMPERATURE

Essentially all prior art CFB units operated at a temperature of 1550°–1650° F. Such high temperatures were believed necessary for stable operation and for complete CO combustion. Such high temperatures also increase $NO_x$ emissions. Operation at lower temperatures will reduce $NO_x$ emissions, simplify the metallurgy needed in the unit, and (unfortunately) reduce slightly the thermal efficiency of the unit. The process of the present invention permits reduced $NO_x$ emissions at the high temperatures used currently in CFBC units, and will also work at somewhat lower temperatures, such as 13000–1500 F. With CO combustion promoter, the CFB unit can operate stably at a much lower temperature, below 1500° F. and preferably within the range of 1350–1450. The lower temperature operation significantly reduces $NO_x$ emissions, but does not impair complete CO combustion.

AIR RATES

Prior art CFB units operated with an average of 20 percent excess air, to ensure complete CO afterburning. It is beneficial to operate with the minimum amount of excess air needed for good coke burning rates and for relatively complete combustion of CO to $CO_2$. If a CO combustion promoter is present, it is now possible to operate with less than 10 percent excess air, and preferably less than 5 percent excess air. If the unit is well designed, and operation closely monitored, such as by an active control scheme wherein oxygen and/or CO content of the flue gas is used to set the amount of air added to the CFB combustor, it should be possible to operate with only 1 or 2 percent excess air while still ensuring essentially complete combustion of CO to $CO_2$.

STAGED AIR INJECTION

The use of staged air injection to reduce $NO_x$ emissions is conventional, and can be practiced herein. The process of the present invention allows more of the air to be added to the primary combustion zone, and increase the burning rate. Thus our process works well with, but reduces the necessity for, staged air injection.

NH3 ADDITION

Addition of NH3 or urea to the flue gas from, or even to the CFBC unit may be practiced where desired. Some commercial CFBC units now practice this. It is the goal of the present invention to reduce, and preferably eliminate, the need for any addition of NH3 or an NH3 precursor to the unit. Where extremely low levels of $NO_x$ emissions in the flue gas are needed, both technologies can be practiced together, i.e., addition of the $DeNO_x$ catalyst of the invention along with conventional NH3 addition.

EXAMPLE 1 (PRIOR ART)

The following example represents operating conditions in a circulating fluid bed boiler unit which was reported in the literature. The unit is a little unusual in that the feed was wood chips, rather than coal, so a sulfur capturing sorbent was not required to meet $SO_x$ emission limits. A solid particulate material was necessary for proper operation of the unit, so sand was added for heat transfer, proper bed fluidization, etc. Two CFB boiler designs are reported, a Babcock-Ultra Powered CFB boiler and an Energy Factors CFB boiler. Table 1, F. Belin, D.E. James, D.J. Walker, R.J. Warrick "Waste Wood Combustion in Circulating Fluidized Bed Boilers", reported in Circulating Fluidized Bed Technology, II at page 354.

TABLE I

Babcock & Wilcox CFB Boiler Performance Data

| Factors | Unit | Babcock-Ultrapower Design | Babcock-Ultrapower Test | Energy Design | Energy Test |
|---|---|---|---|---|---|
| Electric Load (Gross) | MW | 27.5 | 28.3 | 19.5 | 19.6 |
| Max Steam Flow (MCR) | kg/s | 27.6 | 26.4 | 20.7 | 21.5 |
| | k #/hr | 218.6 | 209.0 | 164.0 | 170.8 |
| Steam Pressure | bar | 86.2 | 85.9 | 87.5 | 87.2 |
| | psig | 1250 | 1245 | 1270 | 1265 |
| Steam Temperature | °C. | 513 | 511 | 513 | 509 |
| | °F. | 955 | 951 | 955 | 949 |
| Feedwater | °C. | 147 | 151 | 186 | 196 |
| Temperature | °F. | 296 | 303 | 367 | 385 |
| Gas/Air Temperatures | | | | | |
| Furnace Exit Gas | °C. | 857 | 873 | 849 | 823 |
| | °F. | 1575 | 1603 | 1560 | 1514 |
| Flue Gas Leaving | °C. | 135 | 128 | 150 | 152 |
| Air Heater | °F. | 275 | 263 | 302 | 305 |
| Air Leaving Air | °C. | 209 | 203 | 191 | 189 |
| eater | °F. | 408 | 398 | 375 | 372 |
| Thermal Efficiency (HHV Basis) | % | 78.8 | 79.8 | 81.3 | 81.3 |
| Fuel Moisture | % | 40.0 | 38.0 | 30.0 | 46.4 |
| Unburned Carbon Loss | % | 1.2 | .01 | 1.2 | 0.0 |
| Excess Air | % | 16 | 24 | 21 | 19 |
| Primary/Overfire Air Split | % | 50/50 | 50/50 | 60/40 | 25/75 |
| Emissions at MCR Limits | | | | | |
| NO lb/$10^6$ BTU | | 0.158 | 0.155 | 0.175 | 0.110 |
| $CO^x$ lb/$10^6$ BTU | | 0.158 | 0.025 | 0.218 | 0.100 |

ILLUSTRATIVE EMBODIMENT (INVENTION)

In this example we estimated the changes that would occur due to the addition of 1000 ppm bismuth, on an elemental bismuth basis, to the circulating solids inventory in the Babcock-Ultrapower unit. The bismuth would be in the form of an oxide, impregnated onto a support to contain about 10 wt. bismuth, on an elemental metal basis. We would add the bismuth as a Bi on silica/alumina support having a particle density of about 2.0 g/cc and an average particle size of about 500 microns. The $DeNO_x$ additive would contain 10 wt.% bismuth, so addition of 1 wt.% additive to the circulating inventory in the CFB would give 1000 ppm bismuth.

By operating with bismuth $DeNO_x$ additive, and keeping all other operating conditions the same, e.g., temperature and excess air, we estimate that $NO_x$ emissions from the unit will be reduced by 50%. Our estimate is based on combustion in bubbling fluidized beds, in a laboratory unit, which does not correspond exactly to CFBC operations.

EXAMPLE 2 (PRIOR ART)

This example shows the amount of $NO_x$ in flue gas generated by a laboratory bubbling fluidized bed combustion unit. The operating conditions in the bubbling fluidized bed included a bed temperature of 700 C., fluidized with a combustion gas containing 10 volume % 02, and operation with 1.5 wt ppm Pt CO combustion promoter present. The particulates in the fluidized bed were spent FCC catalyst, containing 1.0 wt% coke. The nitrogen content of the coke was 3.0 wt%.

The peak $NO_x$ concentration noted was 953 ppm volume. The peak CO concentration was 5.0 mole %, while the peak $CO_2$ concentration was 7.9 mole %.

Example 2 is not representative of FCC regeneration, nor of CFBC combustion, it is presented to provide a base case.

EXAMPLE 3 (Cu-ZSM-5 PREP)

This example shows how to prepare one of the preferred $DeNO_x$ catalyst contemplated for use herein, a copper exchanged ZSM-5 zeolite. The Cu-ZSM-5 was prepared by aqueous ion exchange of NH4-ZSM-5 extrudate having a silica/alumina ratio of about 70/1. The zeolite was exchanged at 85C. using a 0.1 N copper acetate solution at a ratio of 1 g zeolite per 10 ml solution; the pH of the exchange solution was 5. After two hours with occasional stirring, the zeolite was filtered and thoroughly washed with distilled water. The exchange, filter, and wash procedure was repeated two additional times. The catalyst was then air-dried at 150 C. Prior to testing, it was ground and sized to 120/400 mesh material. It was not calcined. An elemental analysis showed 4.6 wt% Cu.

More details on preparation of copper exchanged zeolites, and their use, are disclosed in U.S. Ser. No. 433,407, now U.S. Pat. No. 4,980,052, which is incorporated herein by reference. Additional details regards preparation of these materials is also contained in U.S. Ser. No. 454,475, filed Dec. 21, 1989, and incorporated herein by reference.

EXAMPLE 4 (BOUND Cu-ZSM-5 PREP)

This example shows how to prepare another preferred $DeNO_x$ catalyst contemplated for use herein. This catalyst was prepared by aqueous ion exchange of a silica-alumina bound ZSM-5 having a silica/alumina ratio of about 26/1. The bound ZSM-5 was obtained in a spray dried form, suitable for direct use in FCC applications, and consisted of 75% binder/25% ZSM-5. The ion exchange procedure was carried out using copper acetate solution as described in Example 3, as was the drying and calcination. An elemental analysis showed 2.2 wt% Cu.

EXAMPLE 5 (BOUND Cu-ZSM-5 AS $DeNO_x$ CATALYST)

In order to determine the effectiveness of the bound Cu-ZSM-5 catalyst at reducing $NO_x$ emissions in highly oxidizing atmospheres, Example 2 was repeated, but this time the bubbling fluidized bed also contained 5 wt% of the $DeNO_x$ catalyst prepared in Example 4, i.e., the ZSM-5 in a silica/alumina binder. The combustion gas contained 10% oxygen. The peak $NO_x$ emission produced during a semi-batch combustion of the nitrogen-containing coke was 128 ppm, while the peak CO content of the flue gas was 0.4 %. The peak $CO_2$ content of the flue gas was 8.0%. Addition of the $DeNO_x$ catalyst of Example 4 (bound Cu-ZSM-5) reduced the peak $NO_x$ content of the flue gas to 13% of its former level, i.e., a reduction from 953 ppm volume to 128 ppm volume. The CO emissions were also reduced by 92% as compared to combustion carried out without the $DeNO_x$ catalyst.

A significant, though not necessarily the same, reduction in $NO_x$ emissions from CFBC units can also be expected when adding the copper exchanged zeolites to the CFBC unit.

We Claim

1. In a circulating fluidized bed combustion zone wherein a carbon and nitrogen-containing fuel is burned at an elevated temperature by contact with oxygen-containing gas in a generally vertical combustor comprising a fast fluidized bed of particulates wherein at least a majority of the particulate matter in the fast fluidized bed has a particle diameter in excess of 100 microns, to generate a flue gas/particulate stream which is discharged from the top of the combustor, said flue gas comprising excess oxygen, nitrogen oxides ($NO_x$), fines having a particle diameter less than about 100 microns, and circulating particles having an average particle size of about 100–500 microns, which flue gas passes through a separation means to recover from the flue gas at least a majority of the 100–500 micron particles which are recycled to the circulating fluidized bed combustion zone, the improvement comprising burning said fuel in the presence of a catalytically effective amount of a $DeNO_x$ catalyst which reduces the amount of $NO_x$ present in the flue gas relative to operation without addition of a $DeNO_x$ catalyst.

2. The process of claim 1 further characterized in that the $DeNO_x$ catalyst comprises about 100 ppm to 80 wt%, on an elemental metal basis, of a metal or metal oxide of Ge, Fe, Ni, Co, Cr,Cu, Bi, Pb, Sb, Zn, Sn, Mn or mixtures thereof.

3. The process of claim 1 further characterized in that the $DeNO_x$ catalyst comprises about 0.5 to 25 wt%, on an elemental metal basis, of a metal or metal oxide from Group VB or VA of the periodic table.

4. The process of claim 1 further characterized in that the $DeNO_x$ catalyst comprises bismuth or oxides thereof.

5. The process of claim 1 further characterized in that the the $DeNO_x$ catalyst is deposited on a support having an average equivalent particle diameter of 100 to 1000 microns.

6. The process of claim 1 further characterized in that the $DeNO_x$ catalyst is deposited on a support having an average equivalent particle diameter of 100 to 500 microns.

7. The process of claim 1 further characterized in that the the $DeNo_x$ catalyst is deposited on a support having an average equivalent particle diameter of 500 to 1000 microns.

8. The process of claim 1 further characterized in that the the $DeNO_x$ catalyst is deposited on a support having an average equivalent particle diameter of 400 to 600 microns.

9. The process of claim 1 further characterized in that the $DeNO_x$ catalyst is an oxide of bismuth on an amorphous support containing 0.1 to 80 wt % bismuth, on an elemental metal basis, and is present in an amount sufficient to add 0.01 to 10.0 wt% bismuth, on an elemental metal basis, to the circulating inventory of particulates.

10. The process of claim 1 further characterized in that the $DeNO_x$ catalyst is selected from the group of metal exchanged zeolites, zeolites modified with rare earths, perovskites and spinels.

11. The process of claim 10 wherein the $DeNO_x$ catalyst comprises Cu-ZSM-5.

12. The process of claim 1 further characterized in that combustion in the general vertical combustor occurs in the presence of a CO combustion promoter selected from the group of Pt, Pd, Ir, Rh, Os and mixtures thereof present in an amount equal to 0.001 to 100 wt ppm on an elemental metal basis, based on the total particulate inventory in said vertical combustor.

13. In a circulating fluidized bed combustion zone wherein a carbon and nitrogen-containing fuel is burned in the presence of a circulating particle inventory at an elevated temperature by contact with oxygen-containing gas in a generally vertical combustor comprising a fast fluidized bed of particulates wherein at least a majority of the particulate matter in the fast fluidized bed is a sulfur absorbing material such as dolomite or limestone and has a particle diameter in excess of 100 microns, to generate a flue gas/particulate stream which is discharged from the top of the combustor, said flue gas comprising excess oxygen, nitrogen oxides ($NO_x$), fines having a particle diameter less than about 100 microns, and circulating particles having an average particle size of about 100–500 microns, which flue gas passes through a separation means to recover from the flue gas at least a majority of the 100–500 micron particles which are recycled to the circulating fluidized bed combustion zone, the improvement comprising burning said fuel in the presence of at least 0.1 wt %, based on the circulating particulate inventory, of a $DeNO_x$ catalyst which reduces the amount of $NO_x$ present in the flue gas by at least 25% relative to operation without addition of a $DeNO_x$ catalyst.

14. The process of claim 13 further characterized in that the $DeNO_x$ catalyst comprises about 1 to 50 wt%, on an elemental metal basis, of a metal or metal oxide of Ge, Fe, Ni, Co, Cr Cu, Bi, Pb, Sb, Zn, Sn, Mn or mixtures thereof.

15. The process of claim 13 further characterized in that the $DeNO_x$ catalyst comprises a metal containing zeolite.

16. The process of claim 15 wherein the metal containing zeolite is modified with a rare earth.

17. The process of claim 13 further characterized in that the $DeNO_x$ catalyst comprises a spinel.

18. The process of claim 13 further characterized in that the $DeNO_x$ catalyst is present on a particle having an average particle diameter of 100 to 1000 microns.

19. The process of claim 13 further characterized in that the $DeNO_x$ catalyst is an oxide of bismuth on an amorphous support containing 0.1 to 80 wt % bismuth, on an elemental metal basis, and is present in an amount sufficient to add 0.05 to 5 wt% bismuth, on an elemental metal basis to the circulating inventory of particulates.

20. The process of claim 13 further characterized in that combustion in the general vertical combustor occurs in the presence of a CO combustion promoter selected from the group of Pt, Pd, Ir, Rh, Os and mixtures thereof present in an amount equal to 0.001 to 100 wt ppm on an elemental metal basis, based on the total particulate inventory in said vertical combustor.

21. In a circulating fluidized bed combustion zone wherein a carbon and nitrogen-containing fuel is burned at an elevated temperature by contact with oxygen-containing gas in a generally vertical combustor comprising a fast fluidized bed of particulates wherein at least a majority of the particulate matter in the fast fluidized bed is a sulfur absorbing material such as dolomite or limestone and has a particle diameter in excess of 100 microns, to generate a flue gas/particulate stream which is discharged from the top of the combustor, said flue gas comprising excess oxygen, nitrogen oxides ($NO_x$), fines having a particle diameter less than about 100 microns, and circulating particles having an average particle size of about 100–500 microns, which flue gas passes through a separation means to recover from the fluid gas at least a majority of the 100–500 micron particles which are recycled to the circulating fluidized bed combustion zone, the improvement comprising burning said fuel in the presence of a catalytically effective amount of a $DeNO_x$ catalyst which reduces the amount of $NO_x$ present in the flue gas relative to operation without addition of a $DeNO_x$ catalyst.

* * * * *